United States Patent [19]

Yoshikawa

[11] Patent Number: 4,615,309

[45] Date of Patent: Oct. 7, 1986

[54] VALVE ACTUATING MECHANISM FOR INTERNAL COMBUSTION ENGINE

[75] Inventor: Masaaki Yoshikawa, Iwata, Japan

[73] Assignee: Yamaha Hatsudoki Kabushiki Kaisha, Itawa, Japan

[21] Appl. No.: 721,576

[22] Filed: Apr. 10, 1985

[30] Foreign Application Priority Data

Apr. 11, 1984 [JP] Japan ..... 59-70951

[51] Int. Cl.[4] ..... F01L 1/26

[52] U.S. Cl. ..... 123/90.27; 123/90.48; 123/90.55; 123/308; 123/315

[58] Field of Search ..... 123/90.39, 90.4, 90.22, 123/90.23, 90.27, 90.55, 308, 315, 90.48

[56] References Cited

U.S. PATENT DOCUMENTS

| | | | |
|---|---|---|---|
| 1,434,188 | 10/1922 | Belden | 123/90.22 |
| 4,363,300 | 12/1982 | Honda | 123/315 |
| 4,471,730 | 9/1984 | Honda | 123/90.27 |

FOREIGN PATENT DOCUMENTS

| | | | |
|---|---|---|---|
| 0183527 | 11/1982 | Japan | 123/315 |
| 0183553 | 11/1982 | Japan | 123/315 |
| 0186010 | 11/1982 | Japan | 123/90.27 |
| 0018217 | 1/1984 | Japan | 123/90.39 |

*Primary Examiner*—Ira S. Lazarus

*Attorney, Agent, or Firm*—Ernest A. Beutler

[57] ABSTRACT

Several embodiments of valve actuating mechanisms for internal combustion engines that facilitate the use of more intake and/or exhaust valves than the other type of valve. This is accomplished by embodying lifters or tappets that have a smaller diameter for the valves having the greater number.

6 Claims, 5 Drawing Figures

VALVE ACTUATING MECHANISM FOR INTERNAL COMBUSTION ENGINE

BACKGROUND OF THE INVENTION

This invention relates to a valve actuating mechanism for internal combustion engines and more particularly to an improved valve actuating mechanism that permits the use of a greater number of valves per chamber for the engine.

It is generally recognized that the specific output of an internal combustion engine can be improved by increasing the number of valves that serve each chamber of the engine. For this reason, the use of four valve cylinder heads (two intake and two exhaust per combustion chamber) is becoming a widely adopted practice with high performance engines. It has been found that still further performance gains may be enjoyed by using a greater number of valves than four per combustion chamber. However, as the number of valves per combustion engine increases, there are a number of practical considerations that limit the use of such a greater number of valves. Also, it has been proposed to use differing numbers of intake valves from exhaust valves, for example, three intake valves and two exhaust valves. However, when this is done, the size and placement of the various components for actuating and closing the valves makes placement of such multiple numbers of valves very difficult if not impossible.

It is, therefore, a principal object of this invention to provide an improved valve actuating mechanism for an internal combustion engine that permits an increase in the number of valves that may be utilized per combustion chamber.

It is a further object of this invention to provide an improved valve actuating mechanism particularly adapted for engines having differing numbers of intake and exhaust valves per combustion chamber.

SUMMARY OF THE INVENTION

This invention is adapted to be embodied in an internal combustion engine having a combustion chamber defined in part by a cylinder head assembly. Poppet type intake valve means are reciprocally supported by the cylinder head assembly for controlling the flow of an intake charge to the combustion chamber and poppet type exhaust valve means are reciprocally supported by the cylinder head assembly for controlling the flow of exhaust gases from the chamber. The poppet type intake valve means comprise a number of poppet type valves that differs from the number of poppet type valves of the poppet type exhaust valve means. Lifter means are slidably supported by the cylinder head assembly and cooperate with the stems of each of the valve means for urging the valve means toward their opened positions. The outer periphery of the lifter means associated with the poppet type valve means of the greater number has a smaller dimension than the lifter means associated with the other poppet type valves.

DETAILED DESCRIPTION OF THE PREFERRED EMBODIMENTS

As has been aforenoted, the invention is directly primarily toward the valve actuating mechanism and for that reason in the various embodiments of the invention disclosed, only the portion of the engine associated with the valve mechanism has been illustrated in detail and will be described. The application of this principle to conventional reciprocating type engine is believed to be clear to those skilled in the art from this description. In addition, the construction associated with only a single cylinder has been illustrated and described because it is believed that it will be obvious to those skilled in the art how the invention can be practiced with engines having multiple cylinders and various cylinder configurations.

Figure 1:
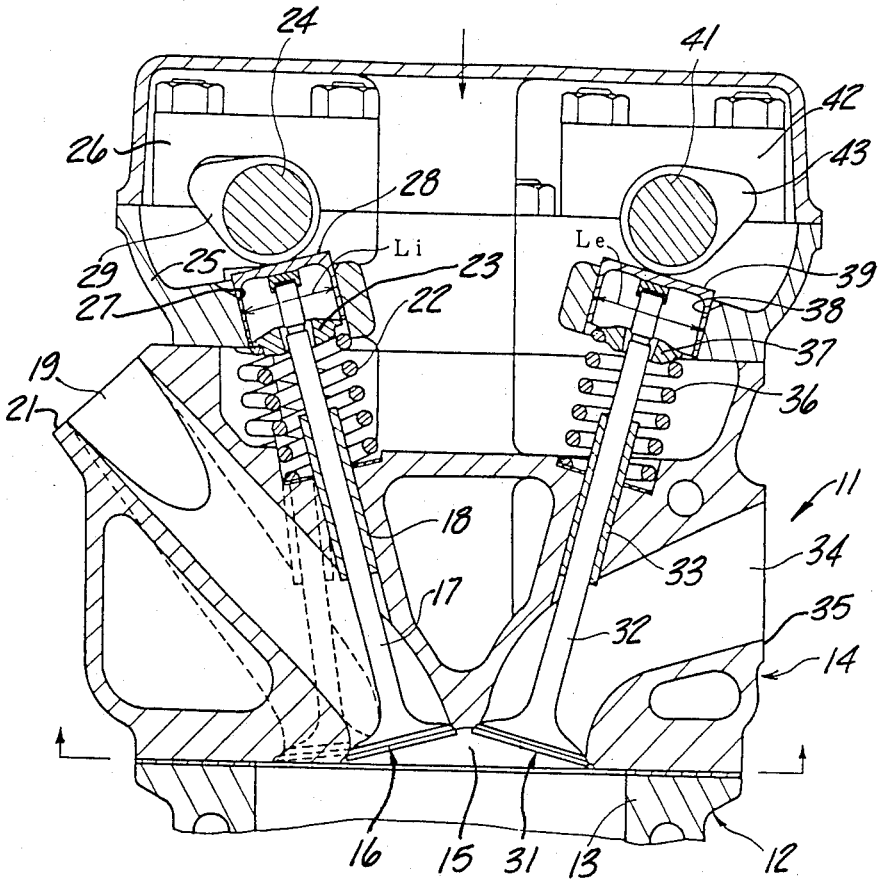
FIG. 1 is a cross-sectional view taken through the single cylinder of an internal combustion engine constructed in accordance with an embodiment of the invention and showing only the upper portion of the engine.
Figure 2:
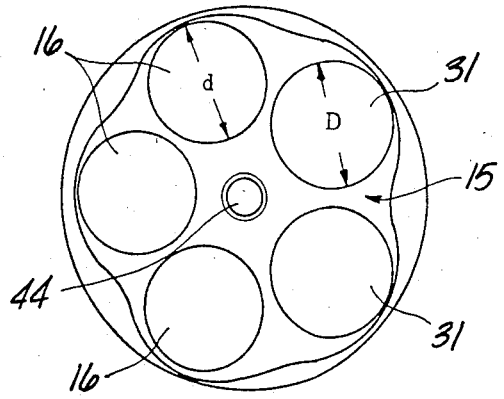
FIG. 2 is a view taken in the direction of the line 2—2 in FIG. 1 and shows the valve placement and cylinder head combustion chamber configuration.
Figure 3:
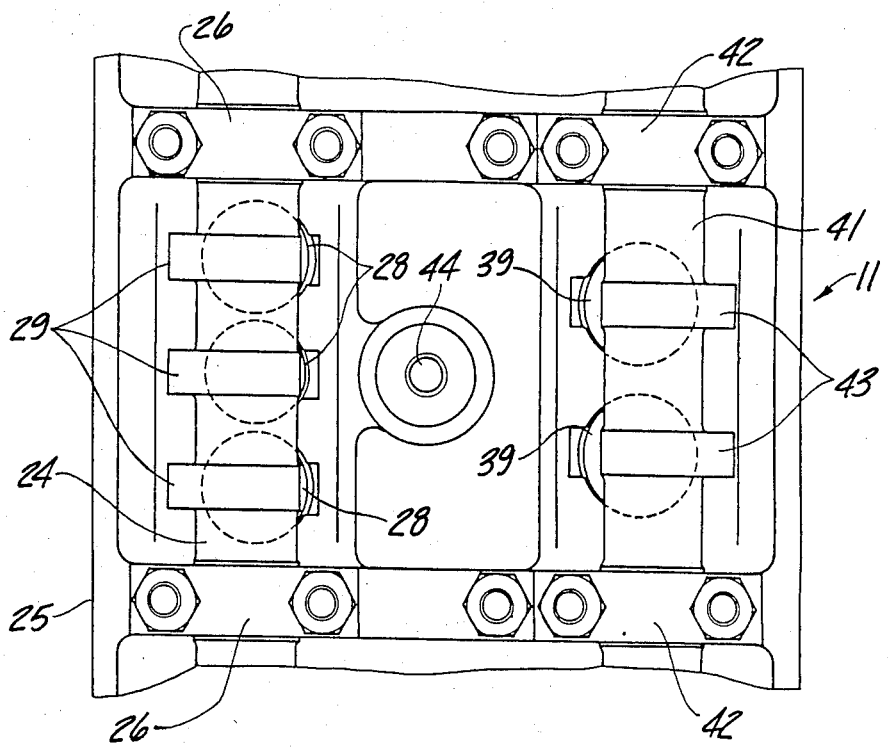
FIG. 3 is a top plan view of the cylinder head assembly with the cam cover removed and looking generally in the direction of the arrow 3 in FIG. 1.

Referring first to the embodiment of FIGS. 1 through 3, an internal combustion engine constructed in accordance with this embodiment is identified generally by the reference numberal 11. The engine 11 includes a cylinder block assembly, indicated generally by the reference numeral 12, in which one or more cylinder bores 13 are formed that reciprocally support pistons (not shown) that are connected to drive a crankshaft in a known manner.

A cylinder head assembly, indicated generally by the reference numeral 14, is affixed to the cylinder block 12 in a known manner and has a number of cavities or recesses 15 that cooperate with the cylinder bores 13 and pistons to provide chambers of varying volume during the reciprocation of the pistons. These chambers and the cavities 15 will at times be referred to as the combustion chamber.

An induction system is provided for delivering a charge to the combustion chamber 15. This induction system includes a plurality, and in the illustrated embodiment, three, poppet type intake valves 16 that have stem portions 17 that are slidably supported to the cylinder head assembly 14 by means of respective valve guides 18 that are pressed into the cylinder head assembly 14. The intake valves 16 and specifically their heads control the flow of intake charge into the chamber 15 from respective valve seats and intake passages 19 that are formed in the cylinder head assembly 14 and which open through an outer face 21 of the cylinder head assembly 14. The intake passages 19 may be separate for each of the intake valves 16 or may be of the siamesed type. A suitable manifold (not shown) which may includes a charge former is affixed to the face 21 for delivering the charge to the intake passages 19.

The orientation of the intake valves 16 is preferably of the form shown in my copending application Ser. No. 369,665, filed Apr. 19, 1982, entitled "Four-Cycle Engine", and assigned to the assignee of this application, and specifically the embodiment of FIGS. 1 through 4 thereof. In view of the reference to this copending application, the detailed description of the preferred valve arrangement and geometrical relationship will not be repeated. Suffice it to say that the axes of reciprocation of the intake valves 16 and specifically their stems 17 all intersect at a line, for a reason to be described.

Coil compression springs 22 encircle each of the valve stems 17 and engage the cylinder head assembly and keepers 23 affixed to the respective valve stems 17 for urging the intake valves 16 to their closed position.

A mechanism is provided for directly actuating the intake valves 16 for opening them against the action of the springs 22. This actuating mechanism includes a camshaft 24 that is supported by the cylinder head assembly 14, in a manner to be described, for rotation about an axis that coincides with the line that is intersected by the stems of the valves 16. For this purpose, a tappet body 25 is affixed to the remainder of the cylinder head assembly 14 in a known manner. Bearing caps 26 are affixed to the tappet body 25 and rotatably journal the intake camshaft 24. The camshaft 24 is driven in any suitable manner in timed sequence with the crankshaft of the engine and at one-half engine crankshaft speed, as is known in this art.

The tappet body 25 is provided with a plurality of cylindrical bores 27 that slidably support thimble tappets or lifters 28 that cooperate with the tips of the valve stems 17 through adjusting shims. The camshaft 24 is provided with cam lobes 29, one for each thimble tappet 28, that operate the thimble tappets 28 and open the intake valves 16 upon rotation of the intake camshaft 24.

On the side of the cylinder head assembly 14 opposite to the intake passages 19 and intake valves 16 there are provided a plurality of exhaust valves 31. In the illustrated embodiment, there are two exhaust valves 31 for each combustion chamber 15. The exhaust valves 31 are of the poppet type and have stem portions 32 that are supported for reciprocation within the cylinder head assembly 14 by pressed in valve guides 33. The heads of the exhaust valves 31 control the flow through exhaust passages 34 formed in the cylinder head and which open through an outer face 35 for cooperation with an appropriate exhaust manifold.

The placement of the exhaust valves 31 relative to the intake valves 16 may also be as aforedescribed in copending application Ser. No. 369,665. Because there are only two exhaust valve per combustion chamber in relation to the three intake valves 16, the heads of the exhaust valves 31 have a larger diameter D than the heads of the intake valves 16 whose diameter is indicated as "d" in FIG. 2. This figure also shows the respective placement of the valves and the configuration of the combustion chamber 15.

Coil valve springs 36 encircle the upper end of the stems 32 of the exhaust valves 31. The springs 36 act against the cylinder head assembly 14 and keepers 37 affixed to the valve stems 32 for urging the exhaust valves 31 to their closed positions.

The tappet body 25 is provided with cylindrical bores 38 that slidably support thimble tappets or lifters 39 that cooperate with the valve stems 32 through adjusting shims. The thimble tappets 39 are actuated by an exhaust camshaft 41 that is supported by the cylinder head assembly 14 in a manner similar to the intake camshaft 24. That is, the camshaft 41 is journaled by the tappet body 25 and bearing caps 42 that are affixed to it in a known manner. The exhaust camshaft 41 has lobes 43 that are engaged with the thimble tappets 39 for actuating the exhaust valves 31 upon rotation of the exhaust camshaft 41. The exhaust camshaft 41 is driven in timed sequence with the crankshaft, in a manner similar to the intake camshaft 24 and which is well known in this art.

A spark plug 44 is supported by the cylinder head assembly 14 and is disposed generally centrally in the combustion chamber 15 for firing the charge in the combustion chamber.

With conventional engines, it has been the practice to employ intake and exhaust thimble tappets 28 and 39 that have substantially the same outer diameter. If this is done with an engine having more intake valves than exhaust valves, it creates problems in connection with the placement of the intake valves and the general overall layout of the cylinder head assembly. In accordance with the invention, however, the diameter Li of the intake tappets or lifters 28 is substantially smaller than the diameter Le of the exhaust tappets or lifters 39. As a result, as may be seen in FIG. 3, it is possible to closely position the valves 16 and still have no interference from the tappets or lifters 28. Said another way, the use of such smaller diameter tappets or lifters permits the desired valve placement and does not compromise the combustion chamber configuration.

Figure 4:
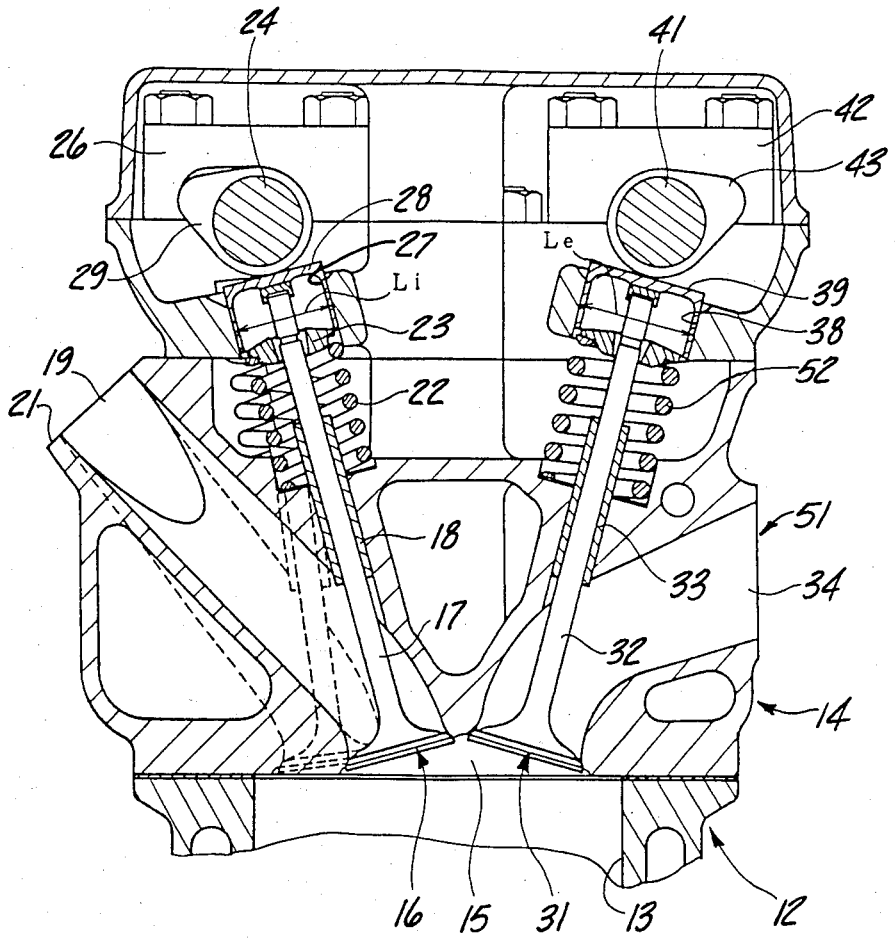
FIG. 4 is a cross-sectional view, in part similar to FIG. 1, and shows a second embodiment of the invention.

Another embodiment of the invention is illustrated in FIG. 4 and is identified generally by the reference numeral 51. As has been previously noted, it is the practice normally to use the same type of lifters for the intake and exhaust valves regardless of the number of the valves that are used. The same is true with respect to the valve springs, that is, it is generally the practice to employ an exhaust valve spring that is the same diameter and formed from the same wire as the intake valves. Since the engine has more intakes than exhaust valves and the exhaust valves are larger, the spring associated with them should be a stiffer spring than that associated with the intake valves. The embodiment of FIGS. 1 through 3 uses the same valve springs for the intake and exhaust valves whereas in the embodiment of FIG. 4, coil compression springs 52 associated with the exhaust valves 31 have a larger wire diameter than the intake valve springs 22. In all other regards, this embodiment is the same as the embodiment of FIGS. 1 through 3 and, for that reason, the components that are the same have been identified by the same reference numerals and will not be described again.

Figure 5:
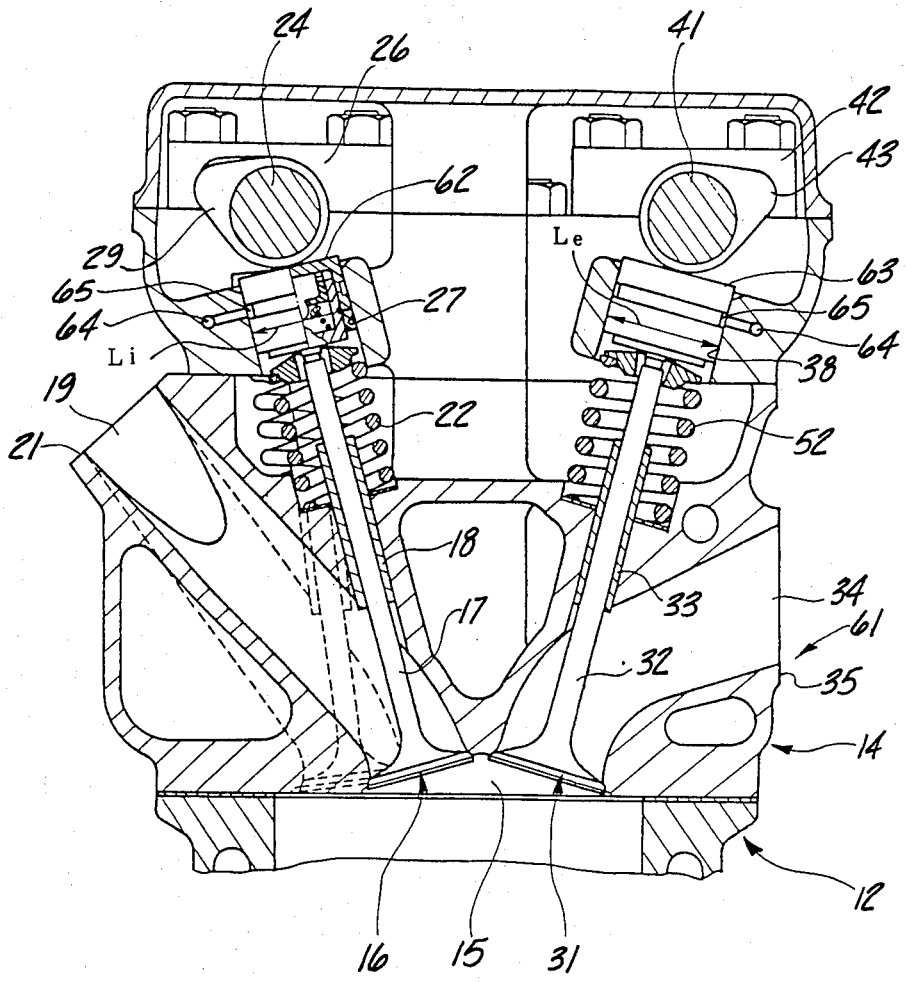
FIG. 5 is a cross-sectional view, in part similar to FIGS. 1 and 4, and shows a third embodiment of the invention.

Yet another embodiment of the invention is shown in FIG. 5 wherein an engine constructed in accordance with this embodiment is identified generally by the reference numeral 61. The engine 61 is substantially the same as the embodiment as shown in FIG. 4 and, for that reason, all components of this embodiment which are the same as that embodiment have been identified by the same reference numeral and these components will not be described again in detail. This embodiment differs from the previously described embodiments in that the mechanical lifters or thimble tappets 28 and 39 associated with the intake and exhaust valves 16 and 31, respectively, are replaced by different hydraulic tappet assemblies, indicated generally by the reference numerals 62 and 63.

The tappet assemblies 62 and 63 may be from any of the known hydraulic types in which the lubricating system oil of the engine is employed in the tappet body 62 and 63 for maintaining zero lash between the respective cam lobes 29 and 43 and the valve stems 17 and 32. For that purpose, oil delivery passages 64 are formed in the tappet body 25 and cooperate with reliefs 65 formed in the individual tappets so as to permit the lubricant to enter tappet body and perform its adjusting function in a known manner. The diameter Li of the tappets 62 is substantially smaller than the diameter Le of the tappets 63 for the reasons aforenoted.

It should be readily apparent from the foregoing description that several embodiments of the invention have been illustrated and described, each of which provides an extremely compact arrangement that permits the use of the more intake valves per cylinder than exhaust valves. Although the invention is described in conjunction with an engine having more intake valves than exhaust valves, it can also be utilized with engines having more exhaust valves than intake valves so long as the lesser number of valves have the greater diameter lifter or tappet assembly associated with it. Although three embodiments of the invention have been illustrated and described, various other changes and modifications may be made without departing from the spirit and scope of the invention, as defined by the appended claims.

I claim:

1. In an internal combustion engine having a combustion chamber defined in part by a cylinder head assembly, poppet type intake valve means reciprocally supported by said cylinder head assembly for controlling the flow of an intake charge to said combustion chamber, poppet type exhaust valve means reciprocally supported by said cylinder head assembly for controlling the flow of exhaust gases from said chamber, said poppet type intake valve means comprising a number of poppet type valves that differs from the number of poppet type valves of the poppet type exhaust valves means, thimble tappet lifter means having a cylindrical portion slidably supported by said cylinder head assembly and encircling the stems of each of said valve means and having a base portion cooperating with the respective valve stem for urging said valve means toward their opened positions, the outer periphery of the cylindrical portion of the lifter means associated with the poppet type valve means of the greater number having a smaller dimension than the lifter means associated with the other poppet type valves.

2. In an internal combustion engine as set forth in claim 1 wherein there are more poppet type intake valves than poppet type exhaust valves.

3. In an internal combustion engine as set forth in claim 2 wherein there are three poppet type intake valves and two poppet type exhaust valves.

4. In an internal combustion engine as set forth in claim 3 further including camshaft means having cam lobes each associated with a respective of the base portions of the thimble tappet lifter means.

5. In an internal combustion engine as set forth in claim 1 further including camshaft means having cam lobes each associated with a respective of the base portions of the thimble tappet lifter means.

6. In an internal combustion engine as set forth in claim 2 further including camshaft means having cam lobes each associated with a respective of the base portions of the thimble tappet lifter means.

* * * * *